US007510127B2

(12) United States Patent
Haji

(10) Patent No.: US 7,510,127 B2
(45) Date of Patent: Mar. 31, 2009

(54) VARIABLE FLOW RATE VALVE AND METHOD OF REDUCING WEAR ON SAME

(75) Inventor: Goudarz Haji, Normal, IL (US)

(73) Assignee: Caterpillar Inc., Peoria, IL (US)

( * ) Notice: Subject to any disclaimer, the term of this patent is extended or adjusted under 35 U.S.C. 154(b) by 917 days.

(21) Appl. No.: 10/771,874

(22) Filed: Feb. 4, 2004

(65) Prior Publication Data

US 2005/0167523 A1 Aug. 4, 2005

(51) Int. Cl.
*F02M 47/02* (2006.01)

(52) U.S. Cl. ..... 239/88; 239/96; 239/570; 137/513.3

(58) Field of Classification Search ..... 239/88–96, 239/570, 571; 137/513.3
See application file for complete search history.

(56) References Cited

U.S. PATENT DOCUMENTS 3,115,304 A 12/1963 Humphries
5,287,838 A 2/1994 Wells
5,505,384 A 4/1996 Camplin
5,641,121 A 6/1997 Beck et al.
6,378,328 B1 * 4/2002 Cholkeri et al. ..... 62/528
6,663,014 B1 12/2003 Depayva et al.

OTHER PUBLICATIONS

Bernd Mahr, Manfred Dürnholz, Wilhelm Polach, and Hermann Grieshaber, Robert Bosch GmbH, Heavy Duty Diesel Engines—The Potential of Injection Rate Shaping for Optimizing Emissions and Fuel Consumption Stuttgart, Germany, at the 21st International Engine Symposium, May 4-5, 2000, Vienna, Austria.

* cited by examiner

*Primary Examiner*—Christopher S Kim
(74) *Attorney, Agent, or Firm*—Liell & McNeil

(57) ABSTRACT

In some fuel injectors, a variable flow rate valve is used to control actuation fluid flow rates to and from an intensifier piston. Over time, the variable flow rate valve is subjected to wear that can affect the predictability of the injection rate shape. The present invention reduces variable flow rate valve wear within a fuel injector, at least in part, by guiding a variable flow rate valve member along guide bore walls within a rate shaping path. The rate shaping path and an unrestricted path are defined by an injector body. When in a retracted position, a moveable intensifier piston includes a first hydraulic surface that is exposed to hydraulic pressure in the unrestricted path and a second hydraulic surface that is exposed to hydraulic pressure in the rate shaping path. The variable flow rate valve member defines a central passage with a predetermined flow area and includes a side surface that separates a closing hydraulic surface from an opening hydraulic surface. The side surface includes a plurality of guide surfaces that separate peripheral flow passages.

13 Claims, 4 Drawing Sheets

VARIABLE FLOW RATE VALVE AND METHOD OF REDUCING WEAR ON SAME

TECHNICAL FIELD

The present invention relates generally to fuel injectors and fuel injector systems, and more specifically to reducing wear on a valve controlling the flow rates of actuation fluid to and from an intensifier piston within the fuel injector.

BACKGROUND

Engineers are constantly seeking strategies for reducing engine emissions. One method of reducing engine emissions is to control numerous fuel injection variables, such as fuel pressure, spray pattern, droplet size, number of injections and injection timing. For instance, it has been found that multiple injections, including pilot and post injections, during a single combustion event reduce emissions. In order to provide multiple injections during a single combustion event with reliable consistency, a fuel injector must often have the ability to reset an intensifier piston quickly while not adversely affecting the desired injection variables.

In order to reduce the amount of time the intensifier piston needs to retract while not affecting the rate shape of the injection caused by the advancing intensifier piston, fuel injectors, such as Caterpillar HEUI™ B unit injector, include a variable flow rate valve positioned in a rate shaping path that fluidly connects a hydraulic surface of the intensifier piston with either a source of actuation fluid or a low pressure drain. Such an injector is shown and described in co-owned U.S. patent application Ser. No. 10/185,946, now U.S. Pat. No. 6,663,014. In order to achieve the desired injection rate shape, the variable flow rate valve restricts the actuation fluid flow in the direction toward the intensifier piston during intensifier piston advancement. In order to quickly reset the intensifier piston, the variable flow rate valve unrestricts the actuation fluid flow in a reverse direction away from the intensifier piston during intensifier piston retraction. The variable flow rate valve includes a disc-shaped valve member with a central passage having a predetermined flow area. The flow of actuation fluid towards the intensifier piston acts to keep the valve member in contact with its valve seat, and restricts the flow of actuation fluid to the central passage of the valve member. When the intensifier piston is retracting, the flow of actuation fluid away from the piston and towards the drain lifts the member off the valve seat and allows the actuation fluid to flow through the central passage of the valve member and also around the sides of the valve member.

Although the variable flow control valve may lessen the time required to reset the intensifier piston, there is room for improvement. Engineers have discovered that the flow control valve member may not always rest against the flat valve seat when the actuation fluid is not acting on the closing hydraulic surface. Thus, when the hydraulic pressure within the rate shaping path builds as the actuation fluid begins flowing toward the intensifier piston in order to advance the intensifier piston, the hydraulic pressure may slam the variable flow rate valve member into contact with the valve seat. The repeated impacts between the valve member and the valve surface can cause the valve member and/or valve seat to wear, which can eventually cause the valve to be unable to fully close when seated. Thus, actuation fluid might eventually flow around the valve member even when the valve member is in the seated position. Because more actuation fluid than desired will be flowing past the worn valve member and acting on the intensifier piston, the injector with the worn valve member or seat will create an injection with characteristics, such as a quantity and rate shape, different than originally desired.

Further, the hydraulic pressure of the actuation fluid acting on the closing hydraulic surface can be uneven, causing the variable flow rate valve member to slant, or even bounce, within the guide bore of the rate shaping path. When the variable flow rate valve member is not aligned within the guide bore, the high pressure actuation fluid can flow around the valve member and through the central passage. Moreover, the actuation fluid flowing through the passages of the slanted variable flow rate valve member can create wear on the variable flow rate valve member. Thus, the flow area through and around the slanted variable flow rate valve member will be different than the flow area around an aligned variable flow rate valve member.

In addition to valve member wear caused by the hydraulic pressure acting on the closing hydraulic surface, wear may be caused to the edges of the valve member by actuation fluid flow around the valve member. The actuation fluid flow around the outer edges of the valve member during the intensifier piston retraction can eventually round the ninety degree corners of the variable flow rate valve member, and thereby alter the flow area around the variable flow rate valve member. The change in the shape of the flow area defined by the valve member over time may also cause a change in the injector performance over time.

Moreover, engineers have found that cavitation within the passages through and around the variable flow rate valve member can also cause wear on the variable flow rate valve member and/or valve seat. Again, the wear on the variable flow rate valve member can alter the flow area around and through the variable flow rate valve member, which in return alters the rate shape and quantity of the injection. Thus, due to variable flow rate valve wear, the ability to control injection variables with consistency and predictability is reduced, and emission reductions can be adversely affected.

The present invention is directed at overcoming one or more of the problems set forth above.

SUMMARY OF THE INVENTION

In one aspect of the present invention, a fuel injector includes an injector body that defines an unrestricted path and a restricted rate shaping path that includes a guide bore and a planar valve seat. When in a retracted position, a moveable intensifier piston has a first hydraulic surface that is exposed to hydraulic pressure in the unrestricted path and a second hydraulic surface that is exposed to hydraulic pressure in the restricted rate shaping path. A variable flow rate valve member is guided to move within the guide bore of the restricted rate shaping path between a first and second position. The variable flow rate valve member defines a central passage that has a predetermined flow area and a side surface that separates a closing hydraulic surface from an opening hydraulic surface. The side surface includes a plurality of guide surfaces that separate peripheral flow passages.

In another aspect of the present invention, a fuel injection system includes a source of actuation fluid and a source of fuel in fluid communication with at least one actuation fluid inlet and a fuel inlet of a fuel injector, respectively. An injector body of the fuel injector defines an unrestricted path and a restricted rate shaping path that includes a guide bore and a planar valve seat. When in a retracted position, a moveable intensifier piston has a first hydraulic surface that is exposed to hydraulic pressure in the unrestricted path and a second hydraulic surface that is exposed to hydraulic pressure within the restricted rate shaping path. A variable flow rate valve member is guided between a first and second position within the guide bore of the restricted rate shaping path. The variable flow rate valve member defines a central passage with a predetermined flow area and a side surface that separates a closing hydraulic surface from an opening hydraulic surface. The side surface includes a plurality of guide surfaces that separate peripheral flow passages.

In yet another aspect of the present invention, there is a method of operating a fuel injector. In order to slow an advancement rate of an intensifier piston over a portion of the intensifier piston advancement, a flow area of a rate shaping path is restricted by a variable flow rate valve relative to a flow area of an unrestricted intensifier path. During the intensifier piston retraction, the flow area of the rate shaping path is unrestricted by the variable flow rate valve relative to the flow area of the rate shaping path during the intensifier piston advancement. By guiding the variable flow rate valve member along guide bore walls within the rate shaping path, the variable flow rate valve wear is reduced.

DETAILED DESCRIPTION

Figure 1:
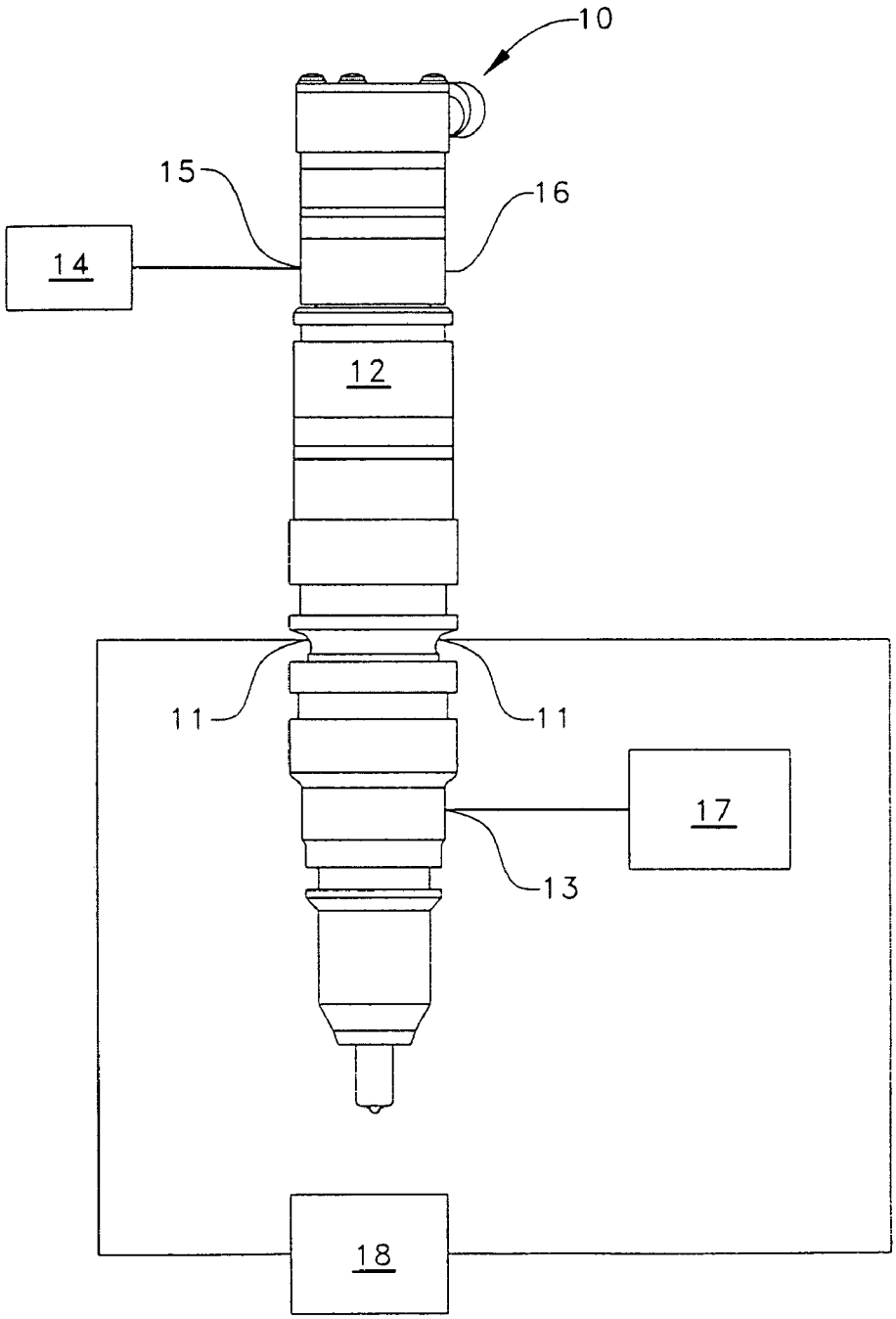
FIG. 1 is a schematic representation of a fuel injection system, according to the present invention.

Referring to FIG. 1, there is shown a schematic representation of a fuel injection system 10, according to the present invention. The fuel injection system 10 includes at least one fuel injector 12 that includes an injector body 16 defining two actuation fluid inlets 11, an actuation fluid drain 15 and a fuel inlet 13. It should be appreciated that the present invention contemplates any number of actuation fluid inlets, including only one. Although the present invention is illustrated as including one fuel injector, it should be appreciated that the present invention can be applied in a fuel system including any number of fuel injectors, and will operate similarly within each fuel injector. A source of actuation fluid 18 and a source of fuel 17 are fluidly connected to the actuation fluid inlets 11 and the fuel inlet 13, respectfully. Although the actuation fluid could be one of various types of fluids, the actuation fluid is preferably a fluid different than the fuel, such as oil. The fuel injector 12 is also in fluid communication with an actuation fluid reservoir 14 via the drain 15.

Figure 2:
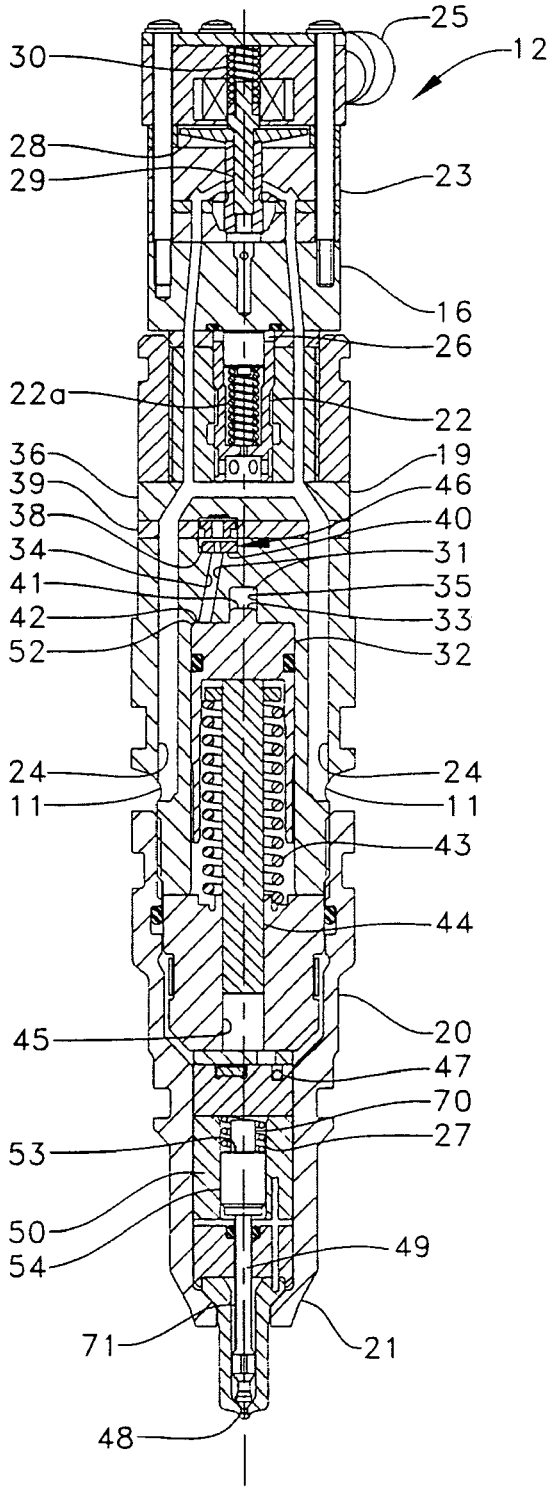
FIG. 2 is a full sectioned view of a fuel injector included within the fuel injection system of FIG. 1.

Referring to FIG. 2, there is shown a full-sectioned view of the fuel injector 12 within the fuel system 10 of FIG. 1. It should be appreciated that the present invention contemplates use within various types of hydraulically actuated electrically controlled fuel injectors. In the illustrated example, the injector body 16 includes a control portion 19, a pressure intensifying portion 20 and a nozzle portion 21. A flow control valve 23 and a spool valve 22 are attached to the control portion 19 of the injector body 16. The flow control valve 23 controls the overall operation of the fuel injector 12 and operates as a pilot valve for the spool valve 22. The flow control valve 23 is fluidly connected to the actuation fluid inlets 11 via actuation fluid inlet passages 24. The flow control valve 23 is also fluidly connected to a spool valve chamber 26 and a needle valve control chamber 27 via a check passage (not shown). A control hydraulic surface of the spool valve 22 is exposed to fluid pressure in chamber 26, which can be high or low depending on the position of control valve 23. The flow control valve 23 includes an armature 28 and a seated pin 29. A solenoid 25 in the flow control valve 23 controls the movement of the armature 28 and therefore the position of the seated pin 29. When the seated pin 29 is in a first position, the flow control valve 23 fluidly connects the actuation fluid inlet passages 24 to the needle valve control chamber 27 and the spool valve chamber 26 via the check passage. Seated pin 29 is normally biased to the first position by a spring 30. When the seated pin 29 is in a second position, flow control valve 23 blocks fluid communication between the actuation fluid inlet passages 24 and the needle valve control chamber 27 and the spool valve chamber 26, which are open to the actuation fluid drain 15 (shown in FIG. 1). Spool valve 22 is normally biased downward by an internal spring 22*a*. Spool valve 22 is normally hydraulically balanced with high pressure acting on both ends. When pressure in chamber 26 is reduced, hydraulic pressure acting on the bottom side of the spool valve 22 will cause it to move upwards against the action of its internal spring 22*a* to open flow of high pressure actuation fluid from passages 24.

Thus, when flow control valve 23 is de-energized, both ends of spool valve 22 are exposed to high pressure and the spool valve is biased downward, as shown, to a first position that blocks a fluid connection between the high pressure passage 24 to the intensifier piston 31. When spool valve 22 is in this downward position, as shown, the passages connected to the intensifier piston 32 are connected to a low pressure drain 15. When pressure is relieved in spool valve chamber 26, hydraulic pressure pushes spill valve 22 upward against the action of its internal spring 22*a* to open the flow high pressure actuation fluid from passages 24 to the intensifier piston 32. When in the second position, the spool valve 22 fluidly connects the actuation fluid passages 24 to a plurality of intensifier passages 31 (partially shown) that include a restricted rate shaping path 34 and an unrestricted path 35. The plurality of intensifier passages 31 are defined, in part, by a flow divider plate 36 and an equalizer plate 39. The intensifier passages 31 fluidly connect the spool valve 22 with at least one hydraulic surface of an intensifier piston 32 that is moveably positioned within the pressure intensifying portion 20 of the injector body 16.

When in a retracted position, the intensifier piston 32 has a first hydraulic surface 41 that is exposed to hydraulic pressure within the unrestricted path 35 and a second hydraulic surface 42 that is exposed to hydraulic pressure within the restricted rate shaping path 34. A piston hat 33 includes the first hydraulic surface 41, and a shoulder 52 of the piston 32 includes the second hydraulic surface 42. The restricted rate shaping path 34 includes a guide bore 38 in which a variable flow rate valve member 40 of a variable flow rate valve 46 is guided to move between first and second position. The movement of the variable flow rate valve member 40 controls the flow area between the spool valve 22 and the intensifier piston shoulder 52.

The intensifier piston 32 is biased toward the retracted, upward position by a biasing spring 43 (as shown in FIG. 2). A plunger 44 is also moveably positioned in the injector body 16 and moves in a corresponding manner with the intensifier piston 32. When pressure acting on the first and second hydraulic surfaces 41 and 42 is sufficiently high, such as when the intensifier passages 31 are open to the actuation fluid inlet passage 24 via the spool valve 22, the intensifier piston 32 is moved toward its advanced position. When the intensifier piston 32 is moved toward its advanced position, the plunger 44 also advances and acts to pressurize fuel within a fuel pressurization chamber 45 that is fluidly connected to the source of fuel 17 via the fuel inlet 13 (shown in FIG. 1) past a check valve 47. As the plunger 44 moves toward its downward position, fuel within the fuel pressurization chamber 45 is pressurized to injection pressure, and the pressurized fuel flows into a nozzle supply passage (not shown) defined by the nozzle portion 21 of the injector body 16. When the plunger 44 is returning to its upward position, fuel is drawn into the fuel pressurization chamber 45 past check valve 47.

The fuel pressurization chamber 45 is fluidly connected to nozzle outlets 48 via the nozzle supply passage (not shown). The opening and closing of the nozzle outlets 48 is controlled by a needle valve 50 positioned in the nozzle portion 21 of the injector body 16. The needle valve 50 includes a needle valve member 49 biased to a closed position by a spring 70. Pressurized fuel within the nozzle supply passage will act on an opening hydraulic surface 71 of the needle valve member 49. When the pressure within the nozzle supply passage reaches valve opening pressure, the needle valve member 49 will move against the bias of the spring and open the nozzle outlets 48, if pressure in a needle control chamber 27 is low. The needle valve 50 is also hydraulically controlled by the needle valve control chamber 27 that is fluidly connected to the flow control valve 23 as stated earlier. A closing hydraulic surface 53 of a needle valve piston 54, which is operably coupled to the needle valve member 49, is exposed to hydraulic pressure within the needle valve control chamber 27. Thus, when the needle valve control chamber 27 is fluidly connected to the actuation fluid inlet passages 24 via the control valve 23, as they normally are, the closing hydraulic surface 53 is exposed to the high pressure actuation fluid. The hydraulic pressure within the nozzle supply passage is insufficient to move the needle valve member 49 against the bias of the spring and the high pressure actuation fluid acting on the closing hydraulic surface 53, even when fuel pressure is high. When the needle valve control chamber 27 is fluidly connected to the drain 15 by energizing control valve 23, the hydraulic pressure in the nozzle supply passage is sufficient to overcome the bias of the spring and open the nozzle outlets 48 of the fuel injector 12.

Figure 3C:
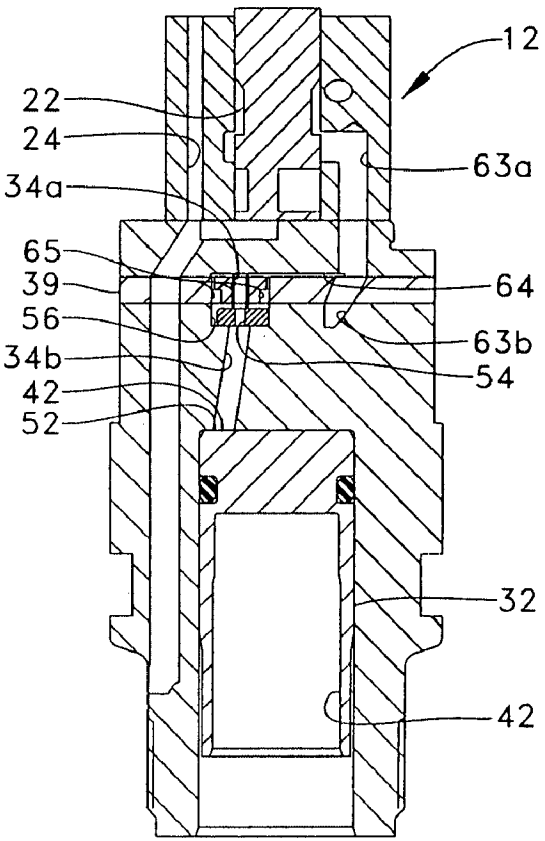
FIG. 3*a-c* are diagrammatic illustrations of various cross sections of a portion of the fuel injector of FIG. 2.
Figure 3B:
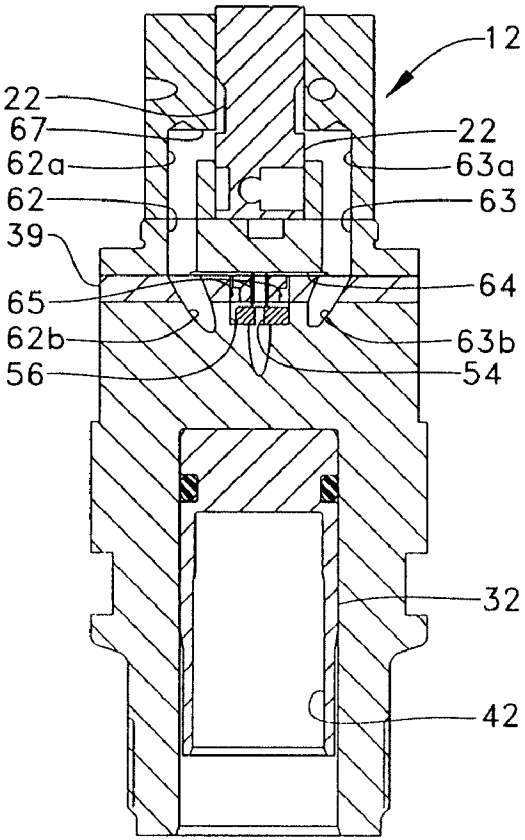
Figure 3A:
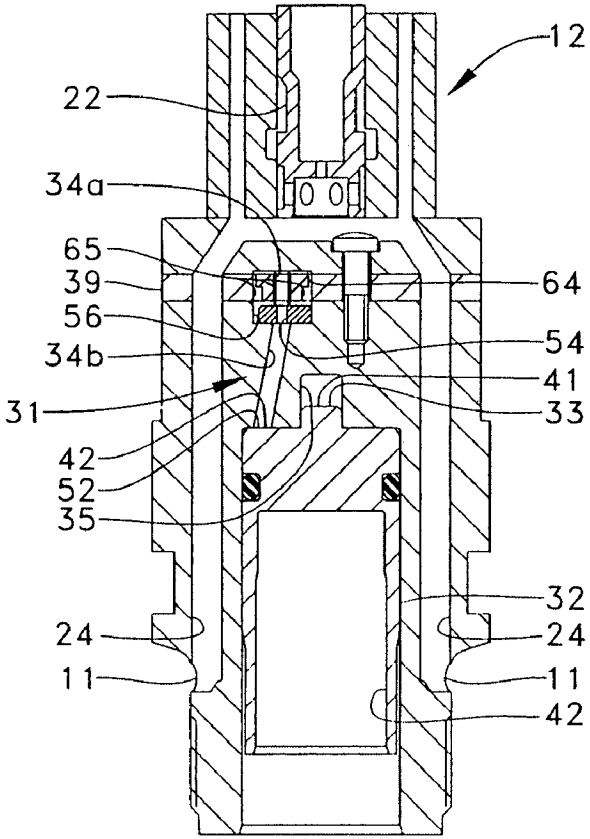

Referring to FIGS. 3*a-c*, there are shown diagrammatic illustrations of various cross sections of a portion of the fuel injector 12 of FIG. 2. FIGS. 3*a-c* illustrate the plurality of intensifier passages 31 fluidly connecting the spool valve 22 to the hydraulic surfaces 41 and 42 of the intensifier piston 32 in the retracted position. Referring specifically to FIG. 3*b*, the intensifier passages 31 include a first opposing passage 62 and a second opposing passage 63 that are fluidly connected to an annulus 67 adjacent the spool valve 22. The opposing passages 62 and 63 include upper portions 62*a* and 63*a* that are parallel to one another and lower portions 62*b* and 63*b* that are angled towards one another. The lower portions 62*b* and 63*b* of the opposing passages 62 and 63 merge above the piston hat 33. The unrestricted path 35 includes both the upper 62*a* and 63*a* and lower portions 62*b* and 63*b* of the opposing passages 62 and 63.

The variable flow rate valve member 40 separates the restricted rate shaping path 34 into a first portion 34*a* that extends between the spool valve 22 and the variable flow rate valve member 40 and a second portion 34*b* that extends between the variable flow rate valve member 40 and the second hydraulic surface 42. The first portion 34*a* of the restricted rate shaping path 34 includes the upper portions 62*a* and 63*a* of the opposing passages 62 and 63. The upper portions 62*a* and 63*a* of the first and second opposing passages 62 and 63 merge in an equalizer chamber 64 defined by the fuel divider disc 36. The first portion 34*a* of the restricted rate shaping path 34 also preferably includes a plurality of equalizer passages 65 that are defined by the equalizer plate 39. The plurality of equalizer passages 65 fluidly connect the equalizer chamber 64 to a central passage 54 through valve member 40 and peripheral passages 56 defined, at least in part, by the outer surface of variable flow rate valve member 40. In the embodiment illustrated, there are four of the equalizer passages 65 distributed around a centerline of central passage 54.

Figure 4:
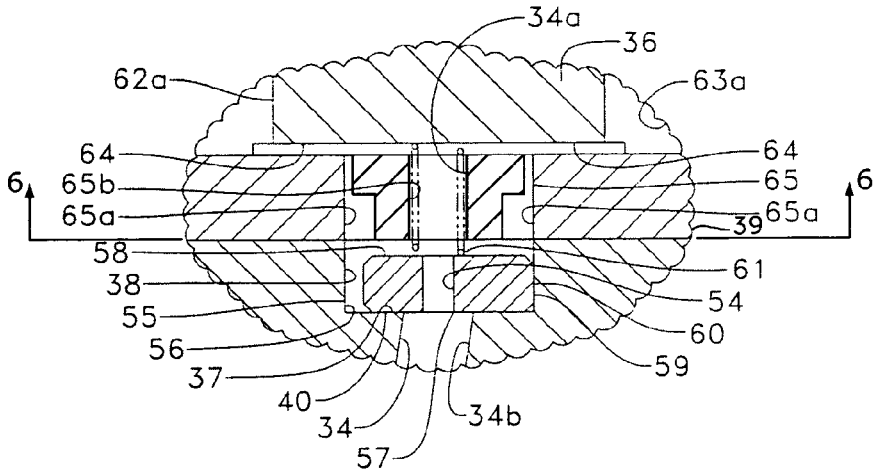
FIG. 4 is a diagrammatic illustration of a cross section of a variable flow rate valve within the fuel injector of FIG. 2.

Referring to FIG. 4, there is shown a diagrammatic illustration of a cross section of the variable flow rate valve 46 within the fuel injector 12 of FIG. 2. The central passage 54 of the variable flow rate valve member 40 has a predetermined flow area. Those skilled in the art will appreciate that the predetermined flow area is sized in order to achieve a desired injection rate shape. The larger the central passage 54, the faster the rate at which the intensifier piston 32 and plunger 44 advance and pressurize the fuel within the fuel pressurization chamber 45 at the beginning of an injection event. In general, the size of the flow area through central passage 54 determines a slope of a front end ramp injection rate shape. The variable flow rate valve member 40 and the guide bore walls 55 define the peripheral passages 56 when valve member is in its unrestricted position in contact with equalizer plate 39. The variable flow rate valve member 40 includes an opening hydraulic surface 57 separated from a closing hydraulic surface 58 by a side surface 59. The side surface 59 includes a plurality of guide surfaces 60 that separate the peripheral flow passages 56.

The variable flow rate valve member 40 is preferably biased by a spring 61 to the first position (as shown) in which the variable flow rate valve member 40 is in contact with a planar valve seat 37 included within the restricted rate shaping path 34. When the flow control valve member 40 is in the first position, the flow control valve member 40 blocks fluid communication between the first portion 34*a* and the second portion 34*b* of the restricted rate shaping path 34 via the peripheral flow passages 56, and thus, restricts fluid communication between the first portion 34*a* and the second portion 34*b* to the central passage 54. As actuation fluid flows from the first portion 34*a* to the second portion 34*b*, the hydraulic pressure acting on the closing hydraulic surface 58 will also act to keep the variable flow valve member 40 in contact with the planar valve seat 37. When the restricted rate shaping path 34 is fluidly connected to the drain 15 and the intensifier piston 32 retracts, the actuation fluid flowing from the second hydraulic surface 42 to the drain 15 will act on the opening hydraulic surface 57 to move the variable flow rate valve member 40 into the second position in which the variable flow rate valve member 40 is out of contact with the planar valve seat 37. When the variable flow rate valve member 40 is in the second position, the first portion 34*a* and the second portion 34*b* of the restricted rate shaping passage 34 are fluidly connected via both the central passage 54 and the peripheral passages 56. Thus, the spring 61 is preferably sufficiently weak that the actuation fluid flow from the second portion 34*b* to the first portion 34*a* of the restricted rate shaping path 34 can quickly lift the variable flow rate valve member 40 off the planar valve seat 37 so that the actuation fluid can be drained and the intensifier piston 32 can reset itself quickly. However, the spring 61 is preferably also sufficiently strong that it holds the variable flow rate valve member 40 into contact with the planar valve seat 37 prior to and during injection events. Those skilled in the art will appreciate that there is a relatively wide range of spring preload strengths that can achieve this compromise.

Referring still to FIG. 4, the first portion 34*a* of the restricted rate shaping path 34 preferably includes the upper portions 62*a* and 63*a* of the first and second opposing passages 62 and 63 that merge in the equalizer chamber 64. The volume of the equalizer chamber 64 can vary, but should be sufficiently large to decrease cavitation through the various passages, but small enough not to alter the desired rate shaping effect of the path. The upper portions 62*a* and 63*a* of the first and second opposing passages 62 and 63 and the equalizer chamber 64 are defined by the flow divider disc 36. The plurality of equalizer passages 65 fluidly connect the equalizer chamber 64 to the central passage 54 and the peripheral passages 56 of the variable flow rate valve member 40. Although there can be any number of equalizer passages 65 positioned in various arrangements, there are preferably at least four peripheral equalizer passages 65*a* positioned around a circumference of an equalizer center passage 65*b*. The equalizer center passage 65*b* also serves as a guide bore for the spring 61. The variable flow rate valve member 40 is positioned within the guide bore 38 such that a center line of the central passage 54 is aligned with a center line of the equalizer central passage 65*b*. Those skilled in the art will appreciate that the size and distribution of the equalizer passages 65 can affect the uniformity of the hydraulic pressure acting on the closing hydraulic surface 58 and the rate shape of the injection. This is also influenced by having fluid enter chamber 64 from two opposing directions originating from passages 62*a* and 63*a*.

Figure 5A:
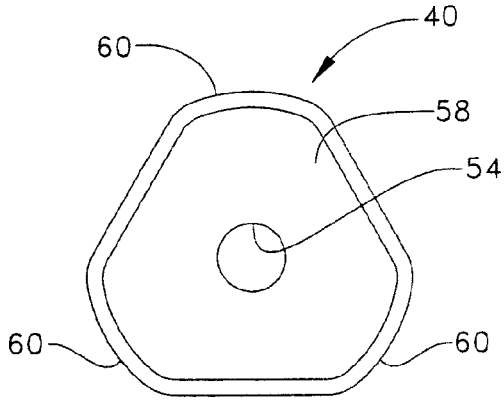
FIG. 5*a* is a top view of the variable flow rate valve member of the variable flow rate valve of FIG. 4.

Referring to FIG. 5*a*, there is shown a top view of the variable flow rate valve member 40 of FIG. 4. Although there can be various numbers of guide surfaces, preferably there are three guide surfaces 60 that separate three peripheral passages 56. The plurality of guide surfaces 60 are preferably segments of a cylinder wall, and each guide surface 60 preferably includes identical segments. Thus, the preferred shape of the variable flow rate valve member 40 is an equilateral triangle with rounded corners. The closing and opening hydraulic surfaces 57 and 58 are preferably identical and include parallel surfaces. Thus, either parallel surface can serve as the closing or opening hydraulic surface of the variable flow rate valve member 40, which reduces the risk of improperly installing the variable flow rate valve member 40 into the guide bore 38.

Figure 5B:
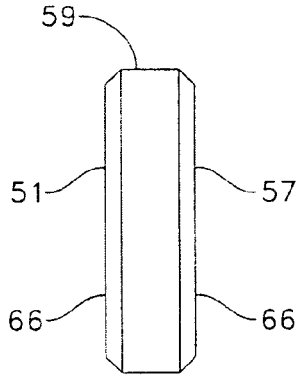
FIG. 5*b* is a side view of the variable flow rate valve member of the variable flow rate valve of FIG. 4.
Figure 6:
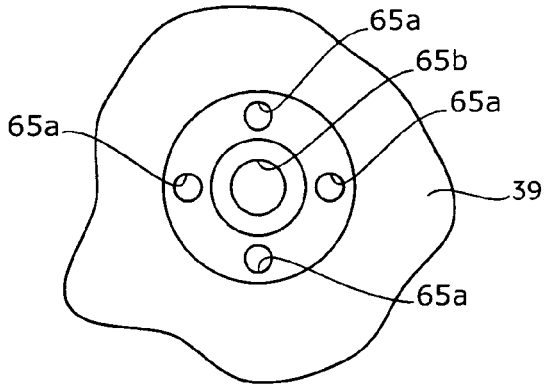
FIG. 6 is a view along section lines 6-6 of FIG. 4.

Referring to FIG. 5*b*, there is shown a side view of the variable flow rate valve member 40 of FIG. 4. The variable flow rate valve member 40 preferably includes a transition surface 66 that is free of right angles and is positioned between the closing hydraulic surface 58 and the side surface 59. An identical transition surface 66 is also positioned between the opening hydraulic surface 57 and the side surface 59. Thus, each parallel surface is surrounded by a bevel 51. Because the valve member 40 is free of right angles between the side surface 59 and the closing and opening hydraulic surfaces 59 and 58, the flow of actuation fluid through the peripheral passages 56 defined, in part, by the side surface 59 will flow over the bevels 51 rather than wear away at abrupt right angle corners. Any corner shape, such as rounded, is preferred relative to square corners.

INDUSTRIAL APPLICABILITY

Although the present invention will be discussed for the fuel injection system 10 using an actuation fluid different than fuel, those skilled in the art should appreciate that the present invention contemplates the fuel injector being hydraulically actuated by any hydraulic fluid, including, but not limited to, fuel.

Referring to FIGS. 1-5, prior to an injection event, the flow control valve 23 is in the first downward position in which the actuation fluid inlet passages 24 are in fluid communication with the needle valve control chamber 27 and the spool valve chamber 26 via a check control passage not shown. The actuation fluid within the needle valve control chamber 27 acts on the closing hydraulic surface 53, ensuring that the needle valve 50 remains closed preventing fuel from flowing through the nozzle outlets 48. Fuel pressure in the injector is low. Further, the actuation fluid within the spool valve chamber 26 equalizes fluid pressure on the spool valve 22 so that an internal spring 22*a* biases it downward to its first position in which the spool valve 22 blocks the actuation fluid inlet passages 24 from the intensifier passages 31, thereby preventing high pressure actuation fluid from acting on the first and second piston hydraulic surfaces 41 and 42. The intensifier piston 32 is in the retracted position. Instead, passages 62 and 63 are fluidly connected to drain is so that hydraulic surfaces 41 and 42 are exposed to low pressure.

When injection is desired, the intensifier piston 32 is advanced by electronically actuating the solenoid 25 of the flow control valve 23, causing the seated pin 29 to move to its second position in which the spool valve chamber 26 is fluidly connected to the drain 15. The spool valve 22 can then move to its second position under the action of hydraulic pressure on its bottom edge overcoming its internal spring 22*a*. In the second position, the spool valve 22 allows high pressure actuation fluid to flow from the actuation fluid inlet passages 24 to the restricted rate shaping path 34 in which the fluid acts on the piston shoulder 52, and via the unrestricted path 35 in which the fluid acts on the piston hat 33, causing the intensifier piston 32 and plunger 44 to advance and pressurize fuel within the fuel pressurization chamber 45.

In order to slow the advancement rate of the intensifier piston 32 over the portion of the intensifier piston advancement prior to the intensifier piston hat 33 clearing the hat bore, the flow area of the rate shaping path 34 is restricted relative to the flow area of the unrestricted path 35. The flow area of the restricted rate shaping path 34 is restricted by the variable flow rate valve 46. The actuation fluid flowing through the first and second opposing passages 62 and 63 will be separated into the restricted rate shaping path 34 and the unrestricted path 35. The actuation fluid flowing along the restricted rate shaping path 34 will flow from the upper portions 62*a* and 63*a* of the opposing passages 62 and 63 and merged into the equalizer chamber 64. The actuation fluid then flows through the four peripheral equalizer passages 65*a* and the center equalizer passage 65*b* to the central passage 54 of the variable flow rate valve member 40. The orientation of the opposing passages 62 and 63 and the arrangement of the equalizer passages 65 helps to create a more uniform hydraulic force that acts on the closing hydraulic surface 58 of the variable flow valve member 40. Thus, the uniform force caused by the flow reduces the risk of the variable flow rate valve member 40 slanting within the guide bore 38. Further, because the variable flow rate valve member 40 is preferably biased by the spring 61 into the first position in which the variable flow rate valve member 40 is in contact with the planar valve seat 37, the variable flow rate valve member 40 is in contact with the planar valve seat 37 prior to the flow of the actuation fluid from the first portion 34*a* to the second portion 34*b* of the restricted rate shaping path 34. Thus, the risk that the hydraulic pressure acting on the closing hydraulic surface 58 slamming the variable flow rate valve member 40 into the planar valve seat 37 and causing wear over time is reduced, if not eliminated.

Because the variable flow rate valve member 40 is in the first position, the peripheral passages 56 are blocked, and the flow of actuation fluid from the first portion 34*a* to the second portion 34*b* of the restricted rate shaping flow path 34 is restricted to the central passage 54. Those skilled in the art will appreciate that the predetermined flow area of the central passage 54 affects the intensifier piston advancement rate, and thus, the rate of fuel pressurization and injection rate, or ramp shape. Thus, the predetermined flow area of the central passage 54 will vary depending on the desired initial injection rate for the fuel injector 12. From the central passage 54, the actuation fluid will flow through the second portion 34*b* of the restricted rate shaping path 34 and act on the shoulder 52 of the intensifier piston 32.

As a portion of the actuation fluid flows from the spool valve 22 to the shoulder 52 in the restricted rate shaping path 34, another portion of the actuation fluid flows through the unrestricted path 35 and acts on the piston hat 33. The hydraulic pressure on the piston hat 33 and the shoulder 52 will cause the intensifier piston 32, and thus the plunger 44, to advance and begin to pressurize the fuel within the fuel pressurization chamber 45. Those skilled in the art will appreciate that if and when the piston hat 33 clears the hat bore during advancement, the rate of advancement hastens, and thus, injection rate also increases.

As the fuel is raised to injection pressure, the fuel will close the check valve 47 and flow into the nozzle supply passage 46 where it will act on an opening hydraulic surface 71 of the needle valve member 49. Because the spool valve 22 is in the second position in which the needle valve control chamber 27 is fluidly connected to the drain 15, the pressure acting on the closing hydraulic surface 53 is low. Consequently, the hydraulic pressure acting on the needle valve member 49 within the nozzle supply passage is sufficient to overcome the bias of the spring to move the needle valve member 49 off the seat and open the nozzle outlets 48. The pressurized fuel is injected into the combustion chamber.

When the end of the injection is desired, flow control valve 23 is de-actuated and the seated pin 29 is moved back to its first position. Thus, actuation fluid will flow from the actuation fluid inlet passages 24 to the spool valve chamber 26 and the needle valve control chamber 27 via the check passage.

The actuation fluid acting on the closing hydraulic surface 53 in the needle valve control chamber 27, along with biasing spring, will move the needle valve member 49 back to its first position closing the nozzle outlets 48. Further, the actuation fluid acting on the spool valve 22 within the spool valve chamber 26 creates a hydraulic balance allowing the spool internal spring 22*a* to move the spool valve 22 back to the first position blocking the actuation fluid inlet passages 24 from the intensifier passages 31 and opening the intensifier passages 31 to the drain 15. Due to the low pressure acting on the intensifier piston 32, the intensifier piston 32 and the plunger 44 will retract, causing the actuation fluid to flow from the unrestricted path 35 and the restricted rate shaping path 34 to the drain 15.

During the intensifier piston retraction, the variable flow rate valve 40 will lift off of planar seat 37 to unrestrict the flow area of the restricted rate shaping path 34 relative to the flow area of the restricted rate shaping path 34 during the intensifier piston advancement. As the actuation fluid flows from the second portion 34*b* to the first portion 34*b* of the restricted rate shaping path 34, the actuation fluid acts on the opening hydraulic surface 57 of the variable flow rate valve member 40, causing the variable flow rate valve member 40 to lift off the planar valve seat 37 against the bias of the spring 61. When the variable flow rate valve member 40 is out of contact with the planar valve seat 37, actuation fluid can flow around the valve member 40 via the peripheral passages 56 in addition to flowing through the central passage 54 of the valve member 40. Because the closing and opening hydraulic surfaces 58 and 57 are surrounded by the bevels 51, the flow of the actuation fluid through the peripheral passages 56 can flow around the bevels 51 providing a smoother transition between the parallel surfaces of the closing and opening hydraulic surface 58 and 57 and the side surface 59. Further, because the flow area of the restricted rate shaping path 34 is unrestricted relative to the flow area of the restricted rate shaping path 34 during intensifier advancement, the rate of intensifier piston retraction is hastened. Thus, the intensifier piston 32 can return to its biased, retracted position more quickly between injections. This quick resetting allows for controlled successive injection events that are close in time to one another.

In order to reduce the wear on the variable flow rate valve member 40, the variable flow rate valve member 40 is guided along the guide bore walls 55 within the restricted rate shaping path 34. Because the three guide surfaces 60 of the variable flow rate valve member 40 are in contact with the guide bore walls 55 when moving between the first and second position, the flow of actuation fluid to and from the intensifier piston shoulder 52 does not cause the variable flow rate valve member 40 to slant within the guide bore 38. It should be appreciated that the guide surfaces 60 should be large enough to help guide the variable flow rate valve member 40 while small enough not to impede flow through the peripheral passages 56 when the intensifier piston 32 is retracting. Thus, even if hydraulic pressure, alone, is used to close the variable for rate valve 46, the guide surface can decrease the wear on the valve by decreasing the risk that the valve member 40 will slant within the guide bore 38.

The variable flow rate valve member 40 is preferably further stabilized within the guide bore 38 by distributing hydraulic pressure over the closing hydraulic surface 58 of the variable flow rate valve member 40. The hydraulic pressure is preferably distributed by dividing the hydraulic flow into the plurality of equalizer passages 65 prior to acting on the closing hydraulic surface 58. Although there can be various distribution patterns of the equalizer passages 65, the equalizer passages 65 are preferably distributed such that the hydraulic force acting on the closing hydraulic surface 58 is uniform. For instance, in the illustrated example, the center equalizer passage 65*b* is aligned with the central passage 54 of the valve member 40, and the peripheral equalizer passages 65*a* are evenly spaced around the circumference of the center equalizer passage 65*b*. Those skilled in the art will appreciate that the size and distribution of the peripheral equalizer passages 65*a* can be adjusted to tune the performance of valve 40. Although there can be any number of peripheral equalizer passages 65*a*, engineers have found that less than four peripheral equalizer passages can increase cavitation, which can lead to valve wear. In the illustrated example, separating the flow of actuation fluid into the first and second opposing passages 62 and 63 prior to merging in the equalizer chamber 64 also contributes to a more uniform hydraulic force acting on the closing hydraulic surface 58 of the variable flow valve member 40.

The variable flow rate valve member wear is preferably also reduced by biasing the variable flow rate valve member 40 with the spring 61 into contact with the planar valve seat 37. Thus, the variable flow rate valve member 40 is in contact with the planar valve seat 37 when the high pressure actuation fluid begins to flow through the spool valve 22 into the restricted rate shaping path 34. An unbiased valve member could be separated from seat 37 by a layer of actuation fluid. Because the variable flow rate valve member 40 is in contact with the planar valve seat 37, the flow of the high pressure actuation fluid acting on the closing hydraulic surface 58 of the variable flow valve member 40 will not slam the variable flow rate valve member 40 into contact with the planar valve seat 37. Moreover, the spring 61 reduces, if not eliminates, the risk of actuation fluid flowing from the first to the second portion 34*a* and 34*b* of the restricted rate shaping path 34 via the peripheral passages 56 prior to the actuation fluid acting on the closing hydraulic surface 58 and moving the variable flow rate valve member 40 into contact with the planar valve seat 37. In addition, the spring can decrease sensitivity to viscosity increases in the actuation fluid, such as during a cold start.

Further, the variable flow rate valve member wear is reduced by reducing cavitation with the rate shaping path 34. In order to reduce cavitation, the volume between the flow control valve 23 and the variable flow rate valve member 40 is increased. In the illustrated example, the equalizer chamber 64 provides an increased flow volume. Those skilled in the art will appreciate that the volume of the equalizer chamber 64 is sufficiently large to reduce cavitation, which can cause variable flow rate valve member wear, but sufficiently small to predictably provide the desired injection rate shape. In other words, an increasing volume can reduce fluid tightness and introduce variability into the injection events. In addition, the variable flow rate valve member wear is reduced by breaking the corners of the variable flow rate valve member 40. The bevels 51 between the side surface 59 and the parallel surface of the opening and closing hydraulic surfaces 57 and 58 provide a smoother transition around the variable flow rate valve member 40. Therefore, the flow of actuation fluid through the peripheral passages 56 does not wear the corners of the variable flow rate valve member 40 and change the flow area of the passages 56. This aspect of the invention is more important in cases when the valve member 40 is unbiased. This is because the valve member may not be in contact with the planar seat 37 when the injection event is initiated. Thus, some flow around the edges will not substantially change the flow characteristics around the edge of valve member 40 with time. Thus, the bevel encourages stable and consistent flow behavior around the valve member even after undergoing millions of injection cycles.

Overall, the present invention reduces the wear on the variable flow rate valve member 40 by using a spring in addition to hydraulic pressure to close the variable flow rate valve 46. Further, the variable flow rate valve member 40 is stabilized within the guide bore 38 by creating a uniform hydraulic force and using guide surfaces 60 to guide the variable flow rate valve member 40 between positions. Moreover, wear is reduced by reducing cavitation within the passages of the restricted rate shaping path 34 and eliminating right angled corners from the variable flow rate valve member 40. It should be appreciated that although the fuel injector 12 preferably includes all of the above wear reducing features, the present invention contemplates a fuel injector including only the guide surfaces 60.

The present invention is advantageous because the reduced variable flow rate valve wear increases the consistency and predictability of the injection rate shape, which leads to increased emissions reductions. Because there is reduced wear on the variable flow rate valve member 40, the variable flow rate valve member 40 maintains its shape, and the flow passages through the restricted rate shaping flow path 34 maintain their desired flow area over time. Thus, the amount of actuation fluid acting on the shoulder 52 of the intensifier piston 32, and therefore, the injection rate shape and quantity, does not change over the life of the injector 12. Therefore, the fuel injector 12 including the variable flow rate valve 46 has the ability to reliably produce close-in-time injection events.

Those skilled in the art will appreciate that the behavior of the flow rate valve member can be fine tuned by a number of different variables. These include the size of central passage 54; the number, size and distribution of equalizer passages 65; and, the volume of equalizer chamber 64. In addition, the shape of valve member 40 can be adjusted to include more than three or less than three guide surfaces and a like number and size of peripheral flow passages 56. In addition, those skilled in the art will appreciate that peripheral passages 56 could be relocated, such as being completely defined by the valve member 40 rather than around the outer edges of the same as in the illustrated embodiment.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A fuel injector comprising:

an injector body defining an unrestricted path and a restricted rate shaping path that includes a guide bore and a planar valve seat;

a moveable intensifier piston, when in a retracted position, including a first hydraulic surface and a second hydraulic surface, and the first hydraulic surface being exposed to hydraulic pressure in the unrestricted path and the second hydraulic surface being exposed to hydraulic pressure in the restricted rate shaping path;

a variable flow rate valve member being guided to move within the guide bore between a first position and a second position, defining a first passage with a predetermined flow area and including a side surface separating a closing hydraulic surface from an opening hydraulic surface, and the side surface including a plurality of guide surfaces separating second passages;

the variable flow rate valve member separates the restricted rate shaping path into a first portion that extends between a flow control valve and the variable flow rate valve member and a second portion that extends between the variable flow rate valve member and the second hydraulic surface of the intensifier piston; and the first portion of the restricted rate shaping path includes at least four peripheral equalizer passages that fluidly connect an equalizer chamber to the first passage and the second passages of the variable flow rate valve member.

2. A fuel injector comprising:

an injector body defining an unrestricted path and a restricted rate shaping path that includes a guide bore and a planar valve seat;

a moveable intensifier piston, when in a retracted position, including a first hydraulic surface and a second hydraulic surface, and the first hydraulic surface being exposed to hydraulic pressure in the unrestricted path and the second hydraulic surface being exposed to hydraulic pressure in the restricted rate shaping path;

a variable flow rate valve member being guided to move within the guide bore between a first position and a second position, defining a first passage with a predetermined flow area and including a side surface separating a closing hydraulic surface from an opening hydraulic surface, and the side surface including a plurality of guide surfaces separating second passages; and the variable flow rate valve member includes a transition surface being free of right angles and being positioned between the closing hydraulic surface and the side surface.

3. The fuel injector of claim 2 including a spring operably positioned to bias the variable flow rate valve member toward the planar valve seat.

4. The fuel injector of claim 3 wherein the variable flow rate valve member includes three guide surfaces.

5. The fuel injector of claim 4 wherein the plurality of guide surfaces being segments of a cylinder wall.

6. The fuel injector of claim 2 wherein the closing hydraulic surface and the opening hydraulic surface having identical effective areas, and including parallel surfaces.

7. The fuel injector of claim 2 wherein the variable flow rate valve member separates the restricted rate shaping path into a first portion that extends between a flow control valve and the variable flow rate valve member and a second portion that extends between the variable flow rate valve member and the second hydraulic surface of the intensifier piston; and the first portion of the restricted rate shaping path includes third and fourth opposing passages merging in an equalizer chamber.

8. The fuel injector of claim 2 wherein the variable flow rate valve member separates the restricted rate shaping path into a first portion that extends between a flow control valve and the variable flow rate valve member and a second portion that extends between the variable flow rate valve member and the second hydraulic surface of the intensifier piston; and the first portion of the restricted rate shaping path includes a plurality of equalizer passages that fluidly connect an equalizer chamber to the first passage and the second passages of the variable flow rate valve member.

9. The fuel injector of claim 8 wherein the plurality of equalizer passages include at least four peripheral equalizer passages positioned around a circumference of an equalizer center passage.

10. The fuel injector of claim 9 including a spring operably positioned to bias the variable flow rate valve member towards the planar valve seat;

the variable flow rate valve member includes three guide surfaces being segments of a cylinder wall;

the closing hydraulic surface and the opening hydraulic surface of the variable flow rate valve member being identical surfaces and include parallel surfaces, each surrounded by a bevel; and the first portion of the restricted rate shaping path includes third and fourth opposing passages merging in the equalizer chamber.

11. A fuel injection system comprising:

a source of actuation fluid;

a source of fuel;

a fuel injector including an injector body defining an actuation fluid inlet being in fluid communication with the source of actuation fluid, a fuel inlet being in fluid communication with the source of fuel, an unrestricted path, and a restricted rate shaping path that includes a guide bore and a planar valve seat; a moveable intensifier piston, when in a retracted position, including a first hydraulic surface and a second hydraulic surface, and the first hydraulic surface being exposed to hydraulic pressure in the unrestricted path and the second hydraulic surface being exposed to hydraulic pressure in the restricted rate shaping path; and a variable flow rate valve member being guided between a first and second position within the guide bore and defining a first passage with a predetermined flow area and including a side surface separating a closing hydraulic surface from an opening hydraulic surface, and the side surface including a plurality of guide surfaces separating second passages;

the variable flow rate valve member separates the restricted rate shaping path into a first portion that extends between a flow control valve and the variable flow rate valve member and a second portion that extends between the variable flow rate valve member and the second hydraulic surface of the intensifier piston; and the first portion of the restricted rate shaping path includes at least four peripheral equalizer passages that fluidly connect an equalizer chamber to the first passage and the second passages of the variable flow rate valve member.

12. The fuel injection system of claim 11 including a spring operably positioned to bias the variable flow rate valve member toward the planar valve seat; and the variable flow rate valve member includes a transition surface being free of right angles and being positioned between the closing hydraulic surface and the side surface.

13. The fuel injection system of claim 12 wherein the actuation fluid being different than the fuel.

* * * * *